US005797807A

United States Patent [19]

Moore

[11] Patent Number: 5,797,807

[45] **Date of Patent: *Aug. 25, 1998**

[54] GOLF CLUB HEAD

[76] Inventor: James T. Moore, 2003 Foxcroft Dr., LaGrange, Ga. 30240

[ * ] Notice: This patent issued on a continued prosecution application filed under 37 CFR 1.53(d), and is subject to the twenty year patent term provisions of 35 U.S.C. 154(a)(2).

[21] Appl. No.: 629,951

[22] Filed: Apr. 12, 1996

[51] Int. Cl.[6] ..... A63B 53/04

[52] U.S. Cl. ..... 473/345; 473/305; 473/349

[58] Field of Search ..... 473/345, 330, 473/328, 305, 292, 338, 349, 324

[56] References Cited

U.S. PATENT DOCUMENTS

| | | | |
|---|---|---|---|
| 3,068,011 | 12/1962 | Sano | 473/328 |
| 3,759,527 | 9/1973 | Witherspoon | 473/330 X |
| 4,432,549 | 2/1984 | Zebelean | 473/345 X |
| 4,725,062 | 2/1988 | Kinney, III | 473/330 |
| 5,288,070 | 2/1994 | Chen | 473/345 X |
| 5,441,263 | 8/1995 | Gorman | 473/328 X |
| 5,482,279 | 1/1996 | Antonious | 473/328 X |
| 5,484,155 | 1/1996 | Yamawaki et al. | 473/328 X |

FOREIGN PATENT DOCUMENTS

| | | |
|---|---|---|
| 891907 | 2/1994 | Japan . |
| 891980 | 2/1994 | Japan . |

*Primary Examiner*—Raleigh W. Chiu
*Attorney, Agent, or Firm*—Watson Cole Grindle Watson, P.L.L.C.

[57] ABSTRACT

A metal wood golf club formed without side walls wherein the crown shares a common outer margin with the sole so that side wall portions are eliminated. The ball striking surface has a marginal edge within a portion of the common outer margin. The hosel extends from the crown adjacent the ball striking surface to a level near an upper extremity of the crown. The metal wood golf club may be formed with a cast forged or molded shell having a hollow interior, the sole and portions of the crown adjacent the common outer margin having a selected thickness and an upper portion of the crown extending from the common margin has a reduced thickness.

18 Claims, 2 Drawing Sheets

FIG. 8
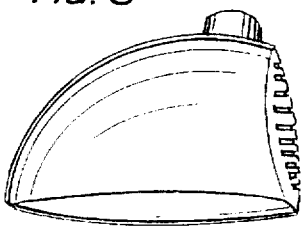
FIG. 9
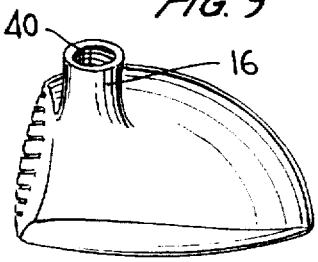
FIG. 10
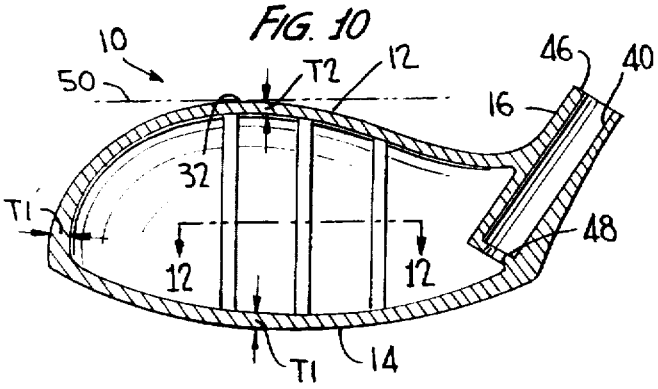
FIG. 11
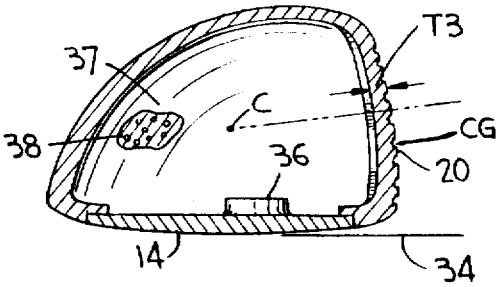
FIG. 12
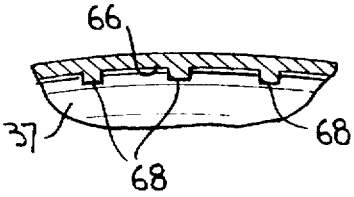
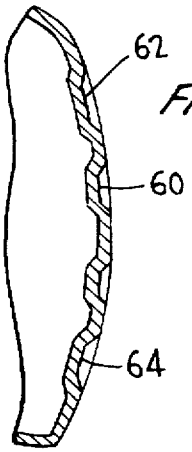
FIG. 13

GOLF CLUB HEAD

BACKGROUND OF THE INVENTION

The present invention relates to a golf club head and in particular, the invention relates to a so-called metal wood head having an improved structural design providing good weight distribution and aerodynamics.

Golf club heads in the so-called wood and metal wood category are formed with a bottom surface or sole, an upper surface or crown and side walls which extend from the outboard or toe end rearwardly and around to the heel portion. A ball striking surface extends from the toe to the heel and a hosel extends from the heel portion to receive a shaft.

Golf club heads, including those of the wood and metal wood type, are made in a variety of sizes and configurations in order to redistribute the weight either upwardly or downwardly or in a heel or toe direction to satisfy the requirements of particular golfers. The various weight distributions help the golfers to achieve maximum ball distance or range. Many golf clubs, because of their shape, result in a higher center of gravity than is otherwise desirable. The high center of gravity causes large back spin which can result in ineffective ball flight. A lower center of gravity can result in a more desirable and optimum launch angle and spin. As a result, the ball travels at a forward angle with more range and a greater roll on the ground.

It is also desirable to manufacture golf club heads with a good aerodynamic design in order to reduce drag and allow the golfer to achieve maximum head speed. Of course, the shape of the club has an effect not only on aerodynamics but also upon weight distribution. It is thus not a trivial matter to optimize the shape of a golf club head for good aerodynamics while at the same time achieving optimized weight distribution.

It is thus desirable according to the present invention to provide a metal wood type golf club having a lowered center of gravity and having reduced aerodynamic drag in a structurally integral casting, forging or the like.

SUMMARY OF THE INVENTION

The present invention is based upon the discovery that a metal wood golf club may be manufactured in such a way that the top or crown shares a common outer margin with the sole or bottom portion of the club so that side wall portions are eliminated, and the ball striking surface has a marginal edge within a portion of the common outer margin and extends generally transverse to the sole and the crown. In a particular embodiment, the hosel extends from the crown adjacent the ball striking surface to a level which may be slightly above an upper extremity of the crown.

In another embodiment, the metal wood golf club is formed with a cast, molded or forged shell having a hollow interior, the sole and portions of the crown adjacent the common outer margin have a selected thickness and an upper portion of the crown extending from the common margin has a reduced thickness.

According to another aspect of the invention, the metal wood golf club has a center of gravity between.the bottom or sole and a geometric center of the head. The ball striking surface may be formed with a uniform thickness corresponding to the sole and with a surface curvature in a range of about 20 cm to about 50 cm (8–20 inches). In a particular exemplary embodiment, the ball striking surface curvature is in a range of about 25 cm to about 30 cm (10–12 inches).

BRIEF DESCRIPTION OF THE DRAWINGS

FIG. 8 is a side elevation taken from the toe end;

FIG. 9 is a side elevation taken from the heel end;

FIG. 10 is a cross-section taken along lines 10—10 of FIG. 8;

FIG. 11 is a cross-section taken along lines 11—11 of FIG. 9;

FIG. 12 is a fragmentary cross-section taken along lines 12—12 of FIG. 10; and FIG. 13 is a fragmentary cross-section taken along lines 13—13 of FIG. 6.

DESCRIPTION OF THE INVENTION

Figure 1:
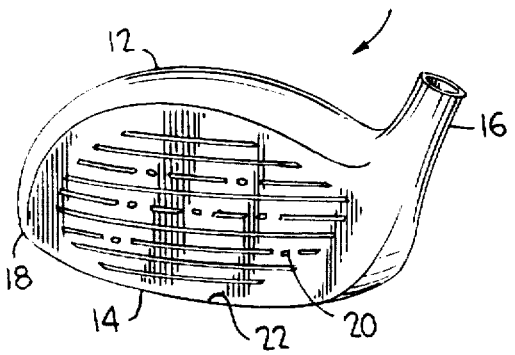
FIG. 1 is a front perspective view of the golf club head according to the present invention with the hosel in the foreground.

FIGS. 1–11 illustrate a golf club head 10 in accordance with the present invention. The club head 10 is of the metal wood type and comprises a top or crown 12, a bottom or sole 14 and a shaft receiving portion or hosel 16 extending generally from the crown 12. The sole 14 and the crown 12 share a common outer margin 18. A ball striking face 20 has a lower marginal edge 22 which is commonly shared with a portion of the common outer margin 18 of the crown and the sole. The ball striking face 20 extends transverse to the crown 12 and the sole 14, as shown.

Figure 2:
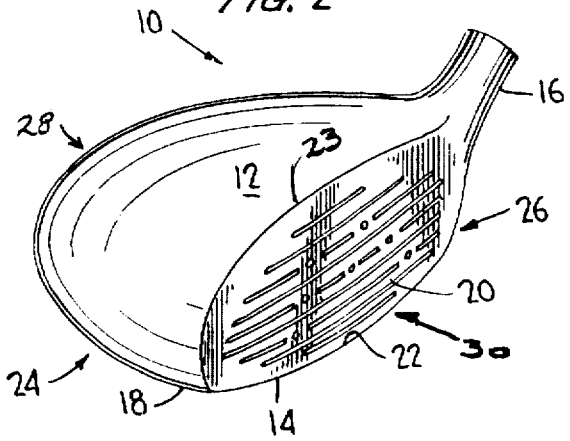
FIG. 2 is a front perspective view of the golf club head according to the present invention with the toe in the foreground.
Figure 3:
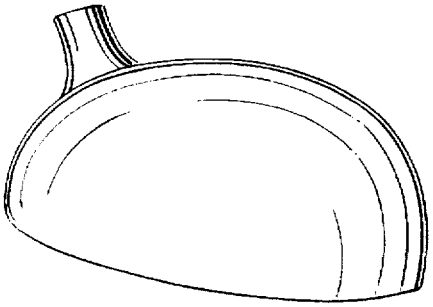
FIG. 3 is a rear perspective view of the golf club head according to the present invention with the toe in the foreground.
Figure 4:
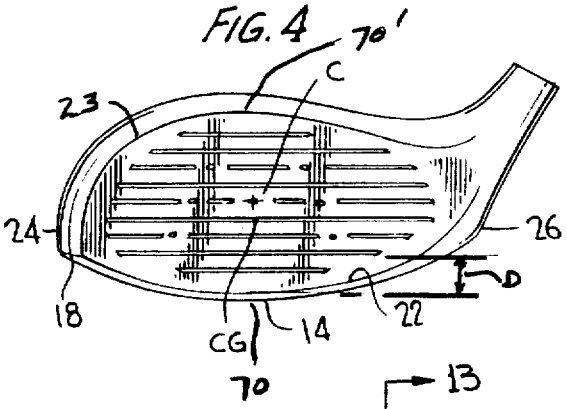
FIG. 4 is a front elevation of the golf club head.

The resulting golf club head 10 of the invention has a toe portion 24, a heel portion 26, a rear 28 and a front 30, as illustrated by the arrows in FIG. 2. The ball striking surface includes an upper marginal edge 23 where the striking face intersects said crown portion, this upper marginal edge extending between the toe portion and the heel portion. Lower marginal edge 22 also extends between the toe portion and the heel portion. The sole 14 of the club head 10 is formed of a cast material having a thickness T1 which extends generally across the entire sole (FIG. 10). The crown 12 is likewise formed with a integrally cast material having a thickness T1 near the common margin 18 and a thickness T2 in the crown 12, as illustrated. The thickness T1 is greater than T2 so as to lower the center of gravity CG of the club 10 to below a geometric center C (FIGS. 4 and 11). The thickness T1 is in a range of about 1.5 mm to about 4.0 mm; T2 is less than T1 and is in a range of about 40% to about 80% of T1. In the exemplary embodiment, T1 is about 3 mm, and T2 is about 50% of T1.

The ball striking face 20 is likewise formed of the cast material and has a thickness T3 (FIG. 11). It should be understood that the thickness T3 of the ball striking face may be varied or weighted to likewise lower the center of gravity of the club head 10. In the arrangement illustrated, the thickness T3 of the face 20 may be uniform and in a range of about 2.5 mm and about 3.5 mm. Alternatively, thickness T3 may taper near the upper portion of the head to the thickness T2.

The center of gravity CG is located below the geometric center C on the face and the lowest point 34 of the club head. In the exemplary embodiment, CG is located approximately halfway between the geometric center C and the lowermost portion 34 of the club head.

The club head 10 may be a hollow casting or forging of aluminum, aluminum alloy and titanium alloy. The sole 14 may be a separate piece (FIG. 11) having a weight 36, if needed, secured thereto. The sole may thereafter be welded to the apertured bottom of the crown to form an integral head, as shown in FIG. 11. Alternatively, the head 10 may be a fiber reinforced plastic and formed with an internal cavity 37. The head 10 may be filled with a thermoplastic 38, for example, polyisobutylene or a gel.

The hosel 16 is formed with an opening 40 for receiving a golf club shaft (not shown) which is secured in the hosel 16 by a ferule (not shown) in a known manner. The opening 40 in the hosel extends from the upper end 46 to the lower end 48 terminating near the sole 14, as illustrated. The hosel extends from the crown portion at the location where marginal edge 23 joins the heel portion 26. Opening 40 extends along an axis 54 which is disposed adjacent the ball striking face 20 as seen in FIG. 5.

In order to maximize the efficiency of a golfer's swing, the hosel 16 is formed in close proximate relation with the club, in that, the upper end 46 terminates at an elevation at or slightly above a line 50 which is tangent to the top 32 of the crown 12 and lies in a horizontal plane when the club head 10 is in the proper striking position, as illustrated in FIG. 10.

In the embodiment illustrated, the crown 12 and sole 14 are joined together along the common outer marginal edge 18 so that the club head 10 is formed essentially without side walls. That is, the crown 12 meets the sole 14 in such a way that the radius of curvature of the crown is relatively larger than a corresponding radial line from the center, and the curvature of the sole is likewise relatively larger (see, for example, FIGS. 4, 8 and 9). In this way, the club has a smooth and uniformly changing curvature without abrupt changes in the radius of curvature along a major portion thereof from the toe to the heel and from the front to the back. In other words, because there are no side walls, there are no abrupt transitions from the crown to the sole.

Figure 5:
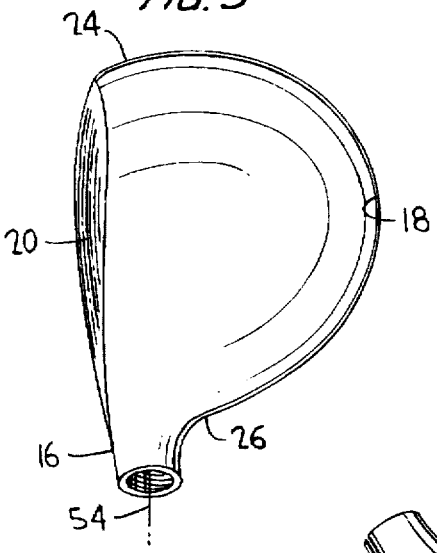
FIG. 5 is a top plan view of the golf club head.

Likewise, in FIG. 5 it can be appreciated that the common outer margin 18 of the club 10 can be viewed as being centered near the axis 54 of the hosel 16 so that the curvature of the outer margin gradually sweeps from the hosel 16 at the heel 26 about the toe 24 and back to the hosel 16, as shown. The curvature of the ball striking face 20 is relatively large so that the ball striking face 20 smoothly joins the toe 24 and the heel 26. The radius of curvature of the ball striking face may lie in a range of about 20 cm to about 50 cm (8–20 inches). In an exemplary embodiment, the curvature is about 30 cm (10–12 inches). The curvature may vary in both the horizontal or bulge direction and the vertical or roll direction or it may be uniform in both. For example, the bulge may be in a range of about 20 to about 50 cm (8–20 inches) and the roll may be in a range of about 25 cm to about 30 cm (10–12 inches).

The shape illustrated in the drawings exemplifies a golf club head 10 having a smooth aerodynamic design and a weight distribution which maximizes the swing efficiency of the golfer. The center of gravity CG is at or below the center C of the club and thus provides optimum loft and spin to the ball.

Figure 6:
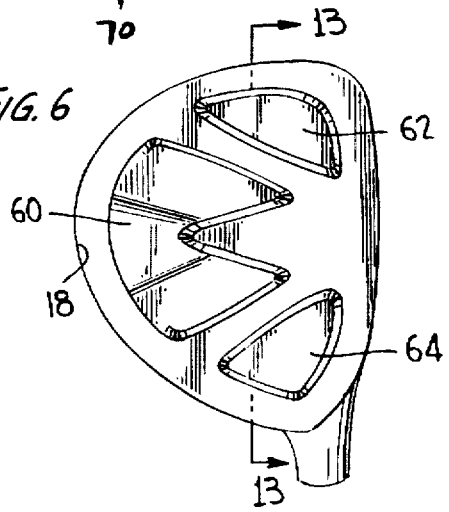
FIG. 6 is a bottom plan view of the golf club head.
Figure 7:
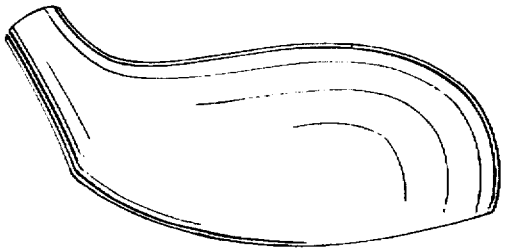
FIG. 7 is a rear elevation of the golf club head.

As seen in FIGS. 5 and 6, a top projection of the club is co-linear with a bottom projection of the club onto the common outer margin. Thus, the sole 14 has a projected area which is approximately the same as the projected area of the crown 12 (excepting, of course, the hosel 16).

The sole 14 may be formed with planar surface portion including a central portion 60 and outboard portions 62 and 64. The central portion 60 is generally parallel to the tangent line 50 when the club is in a neutral playing position. The planar areas may be recessed, as shown in FIG. 13.

The internal walls 66 of the cavity 37 may be formed with ribs 68 (FIG. 12). The ribs 68 provide greater rigidity and strength to the club head 10. As seen in FIG. 4, the lower marginal edge of the ball striking surface defines a continuous downwardly extending generally convex curve from the toe portion to the heel portion. At approximately the mid-point 70 of the lower marginal edge of the ball striking surface, the vertical distance "D" along the ball striking face 20 from the lower marginal edge 22 to a horizontal line "L" extending between the toe portion and the heel portion of the lower marginal edge is at least about 20% of the vertical distance along said ball striking face from point 70 on the lower marginal edge to a point 70' on the upper marginal edge.

The golf club head of the invention generally has a weight consistent with metal wood type clubs and is in a range of about 250 and about 350 grams. In a particular embodiment, the club has a weight of about 180 grams to about 220 grams. The overall club weight with the shaft may be in a range of about 250 and about 360 grams.

While there have been described what are at present considered to be the preferred embodiments of the present invention, it will be apparent to those skilled in the art that various changes and modifications may be made therein without departing from the invention, and it is intended in the appended claims to cover such changes and modifications as fall within the spirit and scope of the invention.

What is claimed:

1. A metal wood golf club head comprising, a crown portion and a sole portion, a toe portion, a heel portion, a ball striking surface extending between said toe portion and said heel portion and between said crown portion and said sole portion, said ball striking surface having a lower marginal edge intersecting said sole portion and extending from said toe portion to said heel portion, said ball striking surface also having an upper marginal edge intersecting said crown portion and extending from said toe portion to said heel portion, a hosel extending from said crown portion at the location where said upper marginal edge joins said heel portion, said hosel having an opening extending therethrough along an axis disposed adjacent said ball striking surface at said heel portion, said crown portion and said sole portion being joined together along a common outer margin to define an edge at said common outer margin, said crown portion defining a continuous curve from said marginal edge to said common outer margin, said crown portion also defining a continuous curve from said heel portion to said common outer margin at said toe portion, said lower marginal edge of said ball striking surface defining a continuous downwardly extending generally convex curve from said toe portion to said heel portion so that at approximately the mid-point along said convex curve, the vertical distance along said ball striking surface from said lower marginal edge to a horizontal line extending between the toe portion and the heel portion of said lower marginal edge is at least twenty percent of the vertical distance along said ball striking surface from said mid-point of said lower marginal edge to said upper marginal edge.

2. The golf club head of claim 1 wherein the crown and sole have projected areas which are approximately equal.

3. The golf club head of claim 1 wherein the sole is formed with a plurality of surface portions.

4. The golf club head of claim 1 wherein the hosel extends from the crown and has a distal end which lies near a horizontal tangent to the crown when the club is in a neutral playing position.

5. The golf club head of claim 1 wherein the sole and portions of the crown adjacent the sole have a thickness in a range of about 1 mm to about 4 mm.

6. The golf club head of claim 1 wherein the crown has a thickness near an upper portion thereof in a range of about 40% to about 80% of the thickness of the sole.

7. The golf club head of claim 1 wherein the club has a geometric center and a center of gravity which lies at or below the geometric center.

8. The golf club head of claim 7 wherein the center of gravity is located approximately halfway between the geometric center and the sole.

9. The golf club head of claim 1 wherein the ball striking surface has a radius of curvature in a range of about 20 cm to about 50 cm.

10. The golf club head of claim 9 wherein the radius of curvature is about 25 to about 30 cm.

11. The golf club head of claim 9 wherein the radius of curvature is uniform toe to heel and from sole to crown.

12. The golf club head of claim 9 wherein the radius of curvature from toe to heel is in a range of about 20 to about 50 cm.

13. The golf club head of claim 9 wherein the radius of curvature from crown to sole is in a range of about 25 cm to about 30 cm.

14. The golf club head of claim 1 wherein the sole has a plurality of planar surfaces.

15. The golf club head of claim 1 wherein the club head is formed of a material selected from a group consisting of aluminum, aluminum alloy and titanium alloy and fiber reinforced resins.

16. The golf club head of claim 1 wherein the club head has a hollow interior and thermoplastic foam or gel is disposed therein.

17. The golf club head of claim 1 wherein the club head has a weight in a range of about 180 grams to about 220 grams.

18. The golf club head of claim 1 wherein the ball striking face has a thickness in a range of about 1.5 mm to about 3.5 mm.

* * * * *